United States Patent [19]

Iwahara et al.

[11] Patent Number: 4,628,525

[45] Date of Patent: Dec. 9, 1986

[54] M-S TYPE STEREOPHONIC MICROPHONE

[75] Inventors: Makoto Iwahara, Sagamihara; Hiroshi Ogawa, Yokohama, both of Japan

[73] Assignee: Victor Company of Japan, Ltd., Japan

[21] Appl. No.: 709,209

[22] Filed: Mar. 7, 1985

[30] Foreign Application Priority Data

Mar. 9, 1984 [JP] Japan ..... 59-33653[U]

[51] Int. Cl.[4] ..... H04R 5/00

[52] U.S. Cl. ..... 381/26; 381/92; 381/94; 179/155

[58] Field of Search ..... 179/121 D, 123, 131, 179/132, 135, 180; 381/26, 71, 91, 92, 94

[56] References Cited

U.S. PATENT DOCUMENTS

| | | | |
|---|---|---|---|
| 2,835,735 | 5/1958 | Moen | 381/71 |
| 3,027,423 | 3/1962 | Reinthaler | 381/26 |
| 3,651,286 | 3/1972 | Gorike et al. | 179/180 |
| 3,989,905 | 11/1976 | Anderson et al. | 179/121 D |
| 4,308,425 | 12/1981 | Momose et al. | 381/92 |
| 4,410,770 | 10/1983 | Hagey | 381/92 |
| 4,453,045 | 6/1984 | Bruna | 179/180 |

FOREIGN PATENT DOCUMENTS

| | | | |
|---|---|---|---|
| 211395 | 10/1960 | Austria | 381/92 |

OTHER PUBLICATIONS

Tremaine, Audio Cyclopedia, 1977, pp. 161-164.

*Primary Examiner*—Forester W. Isen

*Attorney, Agent, or Firm*—Andrus, Sceales, Starke & Sawall

[57] ABSTRACT

An M-S type stereophonic microphone comprises a mid microphone unit having a main axis thereof directed to the front of the M-S type stereophonic microphone, a side microphone unit having a main axis thereof directed to the side of the M-S type stereophonic microphone and perpendicular to the direction of the main axis of the mid microphone unit, a unit support body for unitarily supporting the mid and side microphone units, a main microphone body frame, and a resilient support mechanism comprising resilient support members for resiliently supporting the unit support body on the frame. The resilient support mechanism resiliently supports the unit support body so that the unit support body is movable in the main axis direction of the mid microphone unit and in the main axis direction of the side microphone unit.

7 Claims, 12 Drawing Figures

M-S TYPE STEREOPHONIC MICROPHONE

BACKGROUND OF THE INVENTION

The present invention generally relates to M-S (Mid-Side) type sterophonic microphones, and more particularly to an M-S type sterophonic microphone in which a mid microphone unit and a side microphone unit are supported with an effective vibrationproof effect so that unwanted external vibrations are not transmitted to the mid and side microphone units.

Generally, stereophonic microphones may be divided roughly into X-Y type stereophonic microphones and M-S type stereophonic microphones. Both types of stereophonic microphones are reduced to practice, but the M-S type stereophonic microphones are more popularly used. In an M-S type stereophonic microphone, a uni-directional mid microphone unit and a bi-directional side microphone unit are arranged so that main axes of directivities thereof are perpendicular to each other, which main axes are perpendicular to respective diaphragms and pass the center of the respective diaphragms. By obtaining signals corresponding to the sum and the difference of outputs of the two microphone units, it is possible to compose the directivities of the two microphone units and obtain signals of two channels having two new directivities.

The advantage of the M-S type stereophonic microphone is that the localization and width of sound image can be controlled electrically, because the directivity and direction of the main axis thereof can be changed by changing the proportion of the sum and the difference of the outputs of the two microphone units.

Normally, an M-S type stereophonic microphone used in broadcasting station or the like has the following construction. That is, the M-S type stereophonic microphone comprises a stick-shaped casing comprising a mid microphone unit and a side microphone unit. The two microphone units are arranged so that a main axis of the mid microphone unit is perpendicular to the longitudinal axis of the casing and a main axis of the side microphone unit is perpendicular to both the longitudinal axis of the casing and to the main axis of the mid microphone unit. The M-S type stereophonic microphone is used in such a manner that the main axis of the mid microphone unit is directed toward the front. However, a microphone which is mounted and used in a video camera, 8-mm movie camera and the like, must take into account the fact that a sound source which is to be picked up is located in a direction in which a lens of the camera points. But, the microphone which is mounted on the camera generally has a stick shape extending parallel to the optical axis of the lens, so that the microphone is easily accessible in the state where the microphone is mounted on the camera. In this case, the sound source is located in the longitudinal direction of the stick-shaped microphone. Accordingly, in a case where the M-S type stereophonic microphone is to be used as the stick-shaped microhone for use on the camera, the M-S type stereophonic microphone must be mounted on the camera in such a manner that the main axis of the mid microphone coincides with the longitudinal axis of the M-S type steroephonic microphone and the main axis of the side microphone unit extends in a direction perpendicular to the longitudinal axis of the M-S type stereophonic microphone.

On the other hand, vibrations introduced due to causes such as the fact that the camera is operated in a state where an operator grips the camera with his hands, the rotation of a motor and the manipulation of switches, are transmitted to the microphone through a mounting part (microphone mounting shoe) which mounts the microphone on a main camera body of the camera. When such external vibrations are transmitted to the microphone, unwanted noise are mixed into the output of the microphone. Thus, a vibrationproofing member is provided on a part of a microphone body where a microphone unit is supported, in order to obtain a vibrationproof effect.

As a type of a vibrationproof structure, there is a conventional structure in which the uni-directional microphone unit is mounted on a frame by way of a cushion member made from rubber, urethane resin or other sponge material. However, this conventional vibrationproof structure is disadvantageous in that a sufficient vibrationproof effect cannot be obtained. Hence, there is another conventional vibrationproof structure which will be described later on in the specification by referring to drawings. According to this other conventional vibrationproof structure, rubber support rings are used. The support ring integrally comprises three or four arms extending toward the center of the ring from an outer rim thereof, and a support part is integrally provided at an intersection of the arms. Central parts of the front and rear ends of the uni-directional microphone unit are supported by the central support parts of the pair of support rings. The outer rim of the respective support rings are mounted on the frame, and the uni-directional microphone unit is supported within the frame by the pair of support rings in a suspended state. As a result, the uni-directional microphone unit is supported so that the uni-directional microphone unit is movable in the longitudinal direction of the microphone.

According to this other conventional vibrationproof structure which uses the support rings, the external vibrations which are transmitted from the camera or the like are absorbed to a certain extent by the support rings. Hence, the vibrationproof effect can be obtained to a certain extent. However, due to the provision of the arms, the central support part of the support ring is movable in a direction perpendicular to a plane including the outer rim and the arms of the support ring, that is, in the main axis direction of the microphone unit facing the front of the microphone. But, the central support part of the support ring essentially cannot move in a direction perpendicular to the main axis of the microphone unit facing the front of the microphone. Accordingly, even when the conventional support rings are used in the M-S type stereophonic microphone which is used on the camera as described before, the vibrationproof effect is obtained with respect to the mid microphone unit, but the vibrationproof effect is essentially not obtained with respect to the side microphone unit. Therefore, there is a disadvantage in that the vibrationproof effect as a whole with respect to the external vibrations is insufficient.

SUMMARY OF THE INVENTION

Accordingly, it is a general object of the present invention to provide a novel and useful M-S type stereophonic microphone in which the disadvantages described heretofore are overcome.

Another and more specific object of the present invention is to provide an M-S type stereophonic microphone in which a mid microphone unit and a side microphone unit are supported by resilient support members in such a manner that the two microphone units are movable in directions of respective main axes thereof. According to the M-S type stereophonic microphone of the present invention, it is possible to obtain an effective vibrationproof effect with respect to the two microphone units against external vibrations. Hence, it is possible to obtain from the M-S type stereophonic microphone a satisfactory output having extremely small noise due to the vibrations. The M-S type stereophonic microphone of the present invention is especially effective when used as a microphone which is mounted on a camera or the like and is subject to various vibrations.

Still another object of the present invention is to provide an M-S type stereophonic microphone in which the two microphone units are supported by central parts of arms of a pair of resilient support members, which arms are parallel to a diaphragm of the mid microphone unit and parallel to a diaphragm of the side microphone unit.

Other objects and further features of the present invention will be apparent from the following detailed description when read in conjunction with the accompanying drawings.

DETAILED DESCRIPTION

Figure 1:
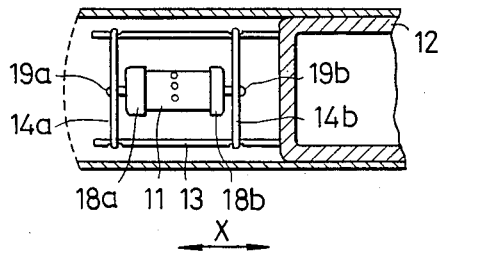
FIG. 1 PRIOR ART
FIG. 1 is a side view in a vertical cross section showing an example of a conventional microphone for use on a camera.

As a conventional microphone for use on a camera, there is a microphone having the construction shown in FIG. 1, for example. In FIG. 1, a uni-directional microphone unit 11 is supported on a frame 13 which is mounted on a body 12, by resilient support members 14*a* and 14*b*. A main axis of the microphone unit 11 is directed toward the front of the microphone, that is, to the left in FIG. 1. For example, the resilient support members 14*a* and 14*b* (14) have the configuration shown in FIG. 2A. The resilient support member 14 (14*a*, 14*b*) shown in FIG. 2A comprises a ring part 15, three arms 16*a*, 16*b* and 16*c* which extend integrally from the ring part 15 toward the center of the ring part 15, and a central part 17 formed integrally at the central part of the ring part 15 where the three arms 16*a*, 16*b* and 16*c* intersect. The resilient support members 14 are secured on the frame 13, and the microphone unit 11 is supported in a state where projections 19*a* and 19*b* provided on respective end caps 18*a* and 18*b* of the microphone unit 11 are fitted into the central parts 17 of the resilient support members 14. Another type of resilient support member 14 has the configuration shown in FIG. 2B. In FIG. 2B, the resilient support member 14 comprises the ring part 15, four arms 16*a* through 16*d* which extend integrally from the ring part 15, and the central part 17 formed integrally at the central part of the ring part 15 where the four arms 16*a* through 16*d* intersect.

The microphone unit 11 supported by the resilient support members 14*a* and 14*b* is movable in a direction X shown in FIG. 1 which is perpendicular to a diaphragm (not shown) of the microphone unit 11, that is, in the main axis direction of the microphone unit 11. External vibrations from outside the microphone are absorbed by the resilient support members 14*a* and 14*b*, and the vibrations transmitted to the microphone unit 11 are reduced.

Figure 2A:
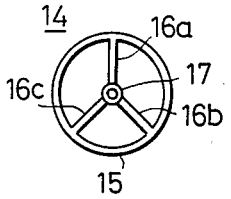
FIG. 2A PRIOR ART
FIGS. 2A and 2B are front views respectively showing examples of resilient support members used in the conventional microphone shown in FIG. 1.
Figure 2B:
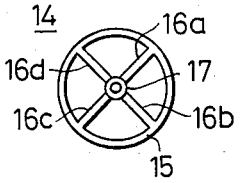
FIG. 2B PRIOR ART

It is possible to obtain a vibrationproof effect with respect to the uni-directional microphone unit 11 to a certain extent by use of the resilient support members 14 (14*a*, 14*b*) shown in FIGS. 2A or 2B. Because the three arms 16*a* through 16*c* or the four arms 16*a* through 16*d* intersect at the central part 17 of the resilient support member 14, the central part 17 is movable in the direction X shown in FIG. 1. However, the central part 17 essentially cannot move in a direction perpendicular to the direction X, that is, in a plane which includes each of the constituting parts of the resilient support member 14. In other words, the central part 17 essentially cannot move in a direction perpendicular to the paper in FIG. 1. Accordingly, in a case where the conventional resilient support members 14 are applied to an M-S type stereophonic microphone in which a mid microphone unit and a side microphone unit are arranged with main axes thereof perpendicular to each other, it is possible to obtain a vibrationproof effect with respect to the mid microphone unit which has the main axis thereof extending parallel to the direction X, however, a vibrationproof effect cannot be obtained with respect to the side microphone unit which has the main axis thereof extending perpendicular to the main axis of the mid microphone unit. Therefore, when a two-channel stereo signal is obtained from the sum and the difference of outputs of the two microphone units, a noise component caused by the external vibrations mixes into the two-channel stereo signal, and a vibrationproof effect cannot be obtained with respect to the M-S type stereophonic microphone.

Figure 3:
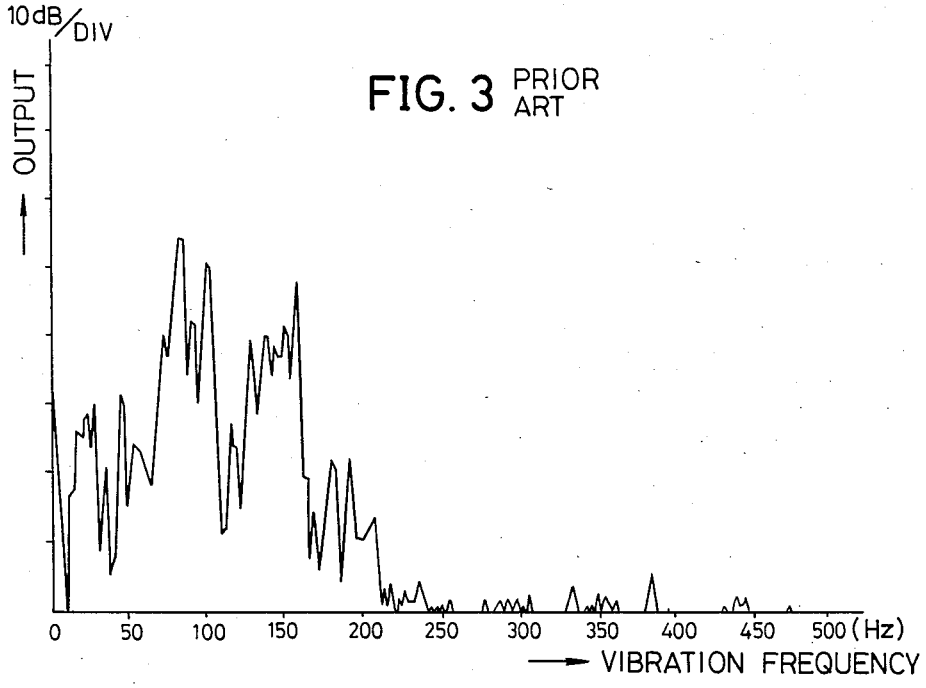
FIG. 3 PRIOR ART
FIG. 3 shows a vibrationproof characteristic of an M-S type stereophonic microphone which uses the conventional resilient support members shown in FIGS. 2A and 2B.

A vibration frequency versus output noise characteristic of theM-S type stereophonic microphone in whcih the mid and side microphone units are supported by the resilient supporting members 14, is shown in FIG. 3. The characteristic shown in FIG. 3 is obtained when the M-S type stereophonic microphone is mounted on the camera by way of a mounting shoe, and external mechanical vibrations are forcibly applied to the M-S type stereophonic microphone by lightly tapping on the mounting shoe. As seen from FIG. 3, peaks of the output noise due to the external vibrations exist in a band of approximately 70 Hz to 105 Hz and in a band of approximately 125 Hz to 165 Hz. The output noise essentially does not exist in a band higher than the band in which the peaks exist, and a vibrationproof effect is obtained in the higher band. However, the output noise is large in a lower band below the frequency of 165 Hz, and a vibrationproof effect is not obtained in the lower band.

For this reason, when the conventional resilient support members 14 are applied to the M-S type stereophonic microphone, noise such as the mechanical noise generated when the operator manipulates a switch of the camera and the rotational noise of a motor which drives a zoom lens of the camera, is picked up by the M-S type stereophonic microphone. As a result, the picked up noise mixes into the output of the M-S type stereophonic microphone, and there is a disadvantage in that the M-S type stereophonic microphone using the conventional resilient support members is not suited for practical use.

Figure 4:
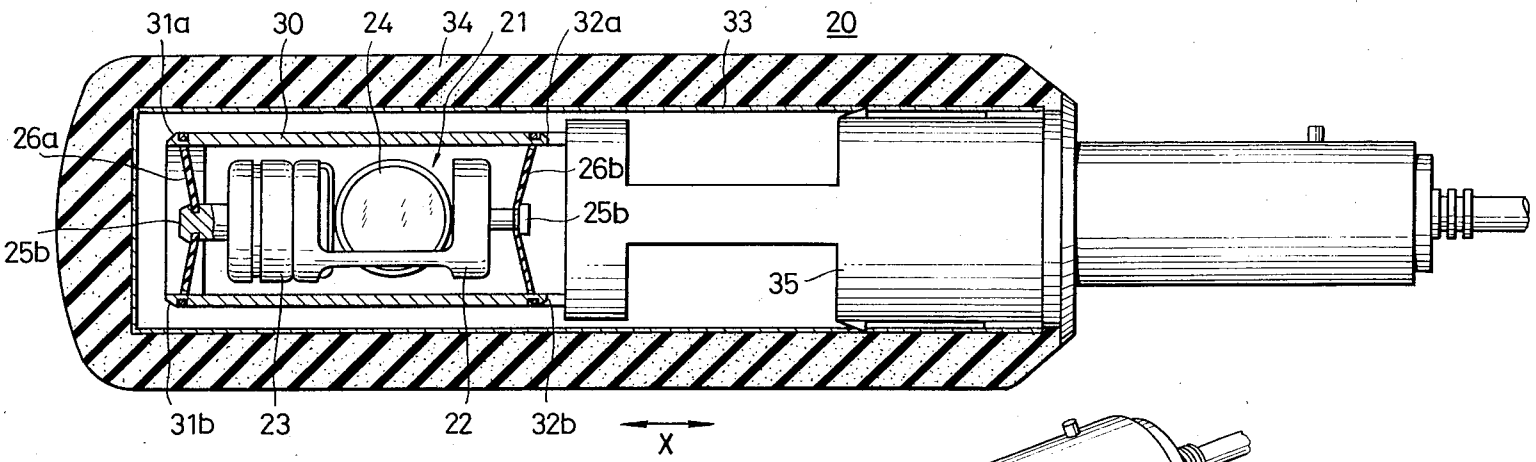
FIGS. 4 and 5 show a side view in a vertical cross section of an embodiment of the M-S type stereophonic microphone according to the present invention.
Figure 5:
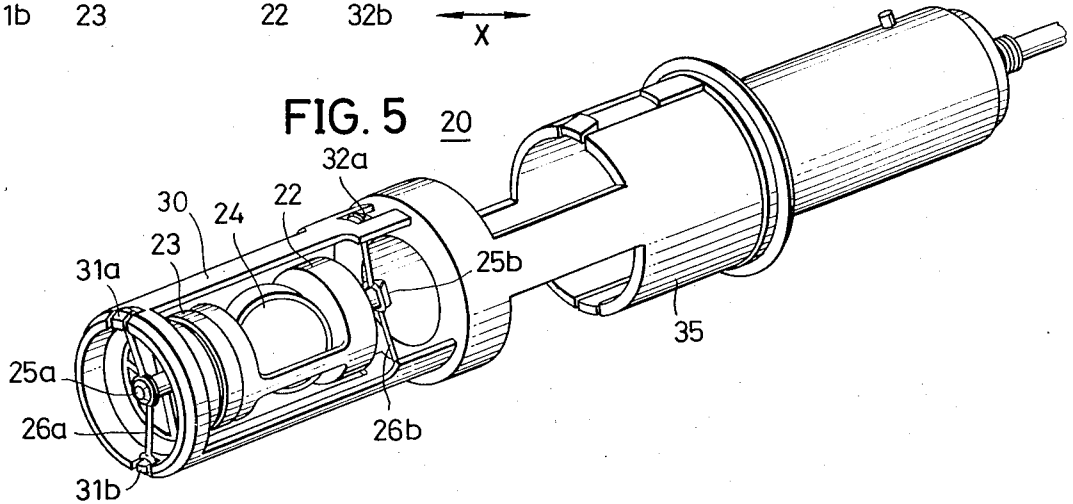

The present invention has eliminated the disadvantages described above, and a description will now be given with respect to the M-S type stereophonic microphone according to the present invention. In FIGS. 4 and 5, an M-S type stereophonic microphone 20 comprises a microphone unit 21. The microphone unit 21 comprises a unit support body 22, a uni-directional mid microphone unit 23 and a bi-directional side microphone unit 24. The mid microphone unit 23 is fixedly mounted on the front part of the unit support body 22 in such a manner that a diaphragm of the mid microphone unit 23 is perpendicular to the paper in FIG. 4 and a main axis of the mid microphone unit 23 is directed to the front along the longitudinal direction of the M-S type stereophonic microphone 20. In other words, the main axis of the mid microphone unit 23 extends in the direction X (to the left in FIG. 4). On the other hand, the side microphone unit 24 is fixedly mounted on the unit support body 22 in such a manner that a diaphragm of the side microphone unit 24 is parallel to the paper in FIG. 4 and a main axis of the side microphone unit 24 is perpendicular to the paper in FIG. 4. In other words, the side microphone unit 24 is mounted on the unit support body 22 facing the side of the M-S type stereophonic microphone 20. Projections 25*a* and 25*b* are integrally formed on respective central parts of the front and rear parts of the unit support body 22.

Figure 6A:
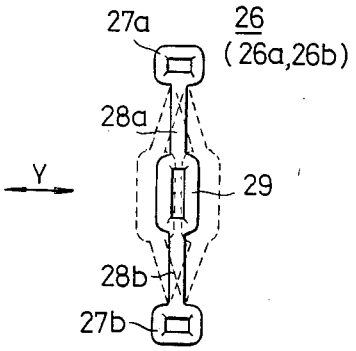
FIGS. 6A and 6B are a front view and a side view in a vertical cross section respectively showing a resilient support member which is used in the M-S type stereophonic microphone shown in FIG. 4.
Figure 6B:
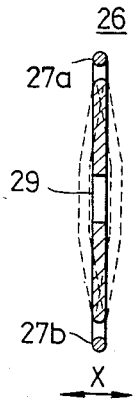

Resilient support members 26*a* and 26*b* (26) have the configuration shown in FIGS. 6A and 6B. The resilient support member 26 comprises engaging parts 27*a* and 27*b* on both ends thereof, a pair of arms 28*a* and 28*b*, and a central engaging part 29. The engaging parts 27*a* and 27*b*, the arms 28*a* and 28*b*, and the central engaging part 29 are integrally formed from a resilient material such as rubber. Each of the engaging parts 27*a*, 27*b* and 29 has a ring shape with a hole at the central part thereof. In the present embodiment, ethylene propylene rubber having a hardness of 45° is used as the resilient material. The projections 25*a* and 25*b* of the unit support body 22 fit into the respective central engaging parts 29 of the resilient support members 26*a* and 26*b*, and the engaging parts 27*a* and 27*b* engage respective hooks 31*a*, 31*b*, 32*a* and 32*b* of a frame 30 of a main microphone body 35. In the state where the unit support body 22 is supported by the resilient support members 26*a* and 26*b*, the unit support body 22 is movable in the direction X in FIGS. 4 and 6B and in a direction perpendicular to the paper in FIG. 4, that is, in a direction Y in FIG. 6A, due to the resilience of the resilient support members 26*a* and 26*b*. The resilient support members 26*a* and 26*b* are hooked onto the respective hooks 31*a* through 32*b* in a state where the resilient support members 26*a* and 26*b* are slightly stretched from the free states thereof, that is, under slight tension. Accordingly, even when the M-S type stereophonic microphone 20 is moved suddenly, the unit support body 22 will not hit the frame 30 by the inertia.

The main microphone body 35 having the construction described heretofore, is accommodated within a punched metal case 33. The outer surface of the case 33 is covered by a resin member 34 of a sponge form so that noise will not be generated by the wind which hits the resin member 34.

The unit support body 22 which is supported by the resilient support members 26 is hence movable in the directions X and Y, that is, in the directions of the main axes of the mid and side microphone units 23 and 24. Accordingly, the external vibrations applied to the M-S type stereophonic microphone 20 are effectively reduced with respect to the two microphone units 23 and 24, and an effective vibrationproof effect is obtained with respect to the two microphone units 23 and 24.

Figure 7:
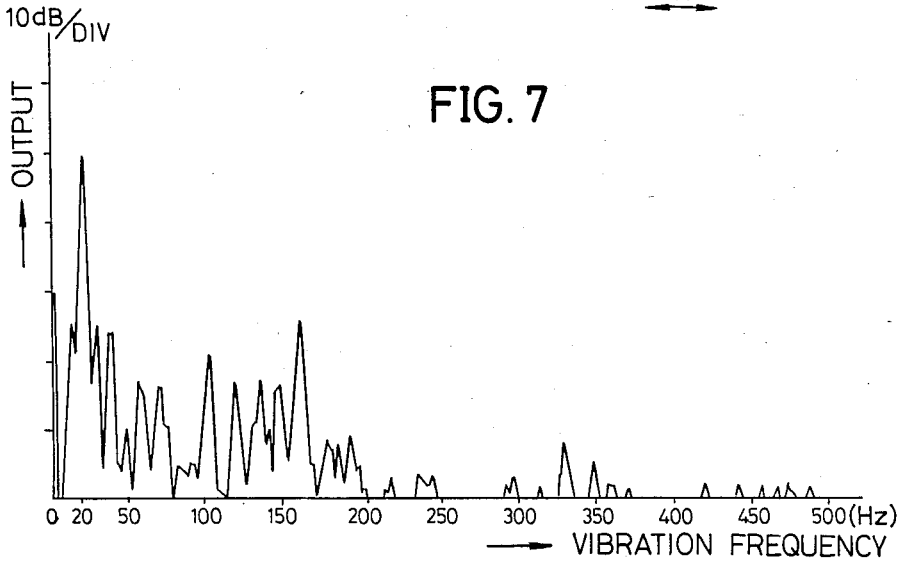
FIG. 7 shows a vibrationproof characteristic of the M-S type stereophonic microphone shown in FIG. 4.

FIG. 7 shows the vibration frequency versus output noise characteristic of the M-S type stereophonic microphone 20 according to the present invention. As is evident from FIG. 7, a peak of the output noise exists in a band in a vicinity of the frequency of approximately 20 Hz, however, the output noise is greatly reduced in higher frequency bands as may be seen by comparing the characteristic of FIG. 7 with the conventional characteristic of FIG. 3. According to the measurements obtained with respect to the present embodiment, the mechanical resonance frequency of a resonant system constituted by the unit support body 22 and the resilient support members 26*a* and 26*b* is equal to 20 Hz with respect to the main axis direction (direction X) of the mid microphone unit 23 and is equal to 19 Hz with respect to the main axis direction (direction Y) of the side microphone unit 24.

The resonance frequency (20 Hz) in FIG. 7 may be decreased by reducing the hardness of the resilient material used for the resilient support members 26*a* and 26*b*, reducing the diameters of the arms 28*a* and 28*b*, and shaping the resilient support members 26*a* and 26*b* so that the tension in the resilient support members 26*a* and 26*b* is reduced in the state where the unit support body 22 is supported on the frame 30. However, when the resonance frequency is decreased in this manner, the microphone units 23 and 24 will move within the frame 30 with a large degree of freedeom. In other words, the microphone units 23 and 24 will move more easily responsive to a sudden movement and stopping of the M-S type stereophonic microphone 20. As a result, there is a problem in that the two microphone units 23 and 24 and the unit support body 22 will hit the frame 30 and generate an abnormal sound (noise) when the two microphone units 23 and 24 move with such ease responsive to the sudden movement and stopping of the M-S type stereophonic microphone 20. In the characteristics shown in FIGS. 4 and 7, the vibrations in the band higher than the resonance (peak) frequency are blocked, and for this reason, less noise is generated when the resonance frequency is low. However, by taking into account the above described problem of noise which is generated when the two microphone units 23 and 24 move too easily responsive to the sudden movement and stopping of the M-S type stereophonic microphone 20, it is desirable that the resonance frequency is in the range of 20 Hz. From the practical point of view, the noise in the range of 20 Hz does not cause problems since the audible band is between approximately 20 Hz and 20 kHz.

Figure 8:
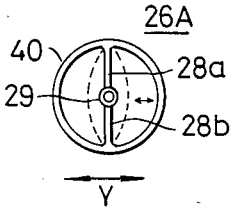
FIGS. 8, 9 and 10 are front views showing other embodiments of the resilient support member which is used in the M-S type stereophonic microphone according to the present invention.
Figure 9:
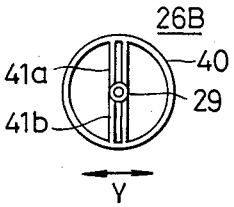
Figure 10:
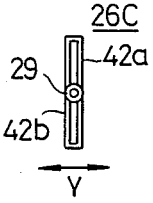

The configuration of the resilient support members 26*a* and 26*b* (26) is not limited to those shown in FIGS. 6A and 6B. As long as the configuration permits resilient deformation in the directions X and Y, the resilient support members 26*a* and 26*b* (26) may have the configurations shown in FIGS. 8 through 10, for example. In the embodiment shown in FIG. 8, a circular ring part 40 of a resilient support member 26A is integrally formed with the pair of arms 28*a* and 28*b* integrally having the central engaging part 29. The ring part 40 is mounted on the frame 30. According to the resilient support member 26A, the central engaging part 29 which engages with the projection 25*a* or 25*b* of the unit support body 22 is movable in the direction (direction X) perpendicular to the paper in FIG. 8 and in the direction Y, together with the arms 28*a* and 28*b*. Hence, it is possible to obtain the same effects as those obtainable in the resilient support member 26.

Each of the pair of arms 28*a* and 28*b* does not need to be constituted by a single arm part. For example, each of the arms 28*a* and 28*b* may be constituted by a double arm part having two mutually parallel arm portions. In a resilient support member 26B shown in FIG. 9, there are provided a pair of double arm parts 41*a* and 41*b*. A pair of double arm parts 42*a* and 42*b* are provided in a resilient support member 26C shown in FIG. 10. In these embodiments shown in FIGS. 9 and 10, the central engaging part 29 is also movable in the direction Y.

The configuration, material, hardness and the like of the resilient support member 26 must be selected so that the unit support body 22 is movable in the direction of the main axis of the mid microphone unit 23 and in the direction of the main axis of the side microphone unit 24 and the resonance frequency of the resonant system is in the range of 20 Hz.

The M-S type stereophonic microphone according to the present invention is not limited to the use on a camera.

Further, the present invention is not limited to these embodiments, but various variations and modifications may be made without departing from the scope of the present invention.

What is claimed is:

1. An M-S type stereophonic microphone comprising:

a mid microphone unit having a main axis thereof directed to the front of said M-S type stereophonic microphone;

a side microphone unit having a main axis thereof directed to the side of said M-S type stereophonic microphone and perpendicular to the direction of the main axis of said mid microphone unit;

a unit support body for unitarily supporting said mid and side microphone units;

a main microphone body frame; and resilient support means comprising resilient support members for resiliently supporting said unit support body on said frame, said resilient support means resiliently supporting said unit support body so that said unit support body is movable in the main axis direction of said mid microphone unit and in the main axis direction of said side microphone unit.

2. An M-S type stereophonic microphone as claimed in claim 1 in which said resilient support means comprises a pair of resilient support members for supporting, on said frame, central parts of both ends of said unit support body along the main axis direction of said mid microphone unit.

3. An M-S type stereophonic microphone as claimed in claim 2 in which each of said pair of resilient support members comprises a central engaging part for supporting the central part of one of the ends of said unit support body, a pair of arms extending integrally from said central engaging part, and a frame engaging part integrally formed on ends said arms, said frame engaging part engaging said frame.

4. An M-S type stereophonic microphone as claimed in claim 2 in which each of said pair of resilient support members is of such a material, size and configuration that a resonance frequency of a mechanical resonant system constituted by said mid and side microphone units, said unit support body and said resilient support members is in a band in the range of 20 Hz.

5. An M-S type stereophonic microphone as claimed in claim 3 in which said unit support body comprises a projection formed at the central part of each of the ends thereof, said central engaging part of said resilient support member has a ring shape for engaging said projection, and said frame engaging part is formed on one end of each of said arms and has a ring shape for engaging an engaging part of said frame.

6. An M-S type stereophonic microphone as claimed in claim 3 in which said unit support body comprises a projection formed at the central part of each of the ends thereof, said central engaging part of said resilient support member has a ring shape for engaging said projection, and said frame engaging part connects to one end of each of said arms and has a ring shape for engaging said frame.

7. An M-S type stereophonic microphone as claimed in claim 3 in which each of said pair of arms comprises a plurality of mutually parallel narrow arm portions.

* * * * *